United States Patent [19]

Ramsey

[11] Patent Number: 4,760,404

[45] Date of Patent: Jul. 26, 1988

[54] DEVICE AND METHOD FOR SEPARATING SHORT-WAVELENGTH AND LONG-WAVELENGTH SIGNALS

[75] Inventor: Vernon W. Ramsey, Huntsville, Ala.

[73] Assignee: The Boeing Company, Seattle, Wash.

[21] Appl. No.: 913,464

[22] Filed: Sep. 30, 1986

[51] Int. Cl.[4] ..... H01Q 13/00; H01P 1/213

[52] U.S. Cl. ..... 343/786; 343/772; 343/783; 333/126

[58] Field of Search ..... 343/772, 773, 775, 777, 343/779, 783, 786; 333/126, 134, 135

[56] References Cited

U.S. PATENT DOCUMENTS

| | | | |
|---|---|---|---|
| 2,975,380 | 3/1961 | Scharfman | 333/9 |
| 3,785,717 | 1/1974 | Croset et al. | 333/10 |
| 3,918,010 | 11/1975 | Marchalot | 333/10 |
| 3,938,159 | 2/1976 | Ajiokz et al. | 343/786 |
| 4,168,504 | 9/1979 | Davis | 343/786 |
| 4,358,770 | 11/1982 | Satoh et al. | 343/786 |
| 4,427,953 | 1/1984 | Hudspeth et al. | 333/134 |
| 4,491,810 | 1/1985 | Saad | 333/126 |
| 4,516,089 | 5/1985 | Goscianski et al. | 333/135 |
| 4,546,471 | 10/1985 | Bui-Hai | 333/135 |
| 4,558,290 | 12/1985 | Lee | 333/126 |

*Primary Examiner*—William L. Sikes
*Assistant Examiner*—Doris J. Johnson
*Attorney, Agent, or Firm*—Finnegan, Henderson, Farabow, Garrett & Dunner

[57] ABSTRACT

A device for separating signals in the long or radar wavelength bands from signals in the short or infrared to ultraviolet wavelength bands which occupy a common area. A waveguide for directing radar band wavelengths has apertures in opposing walls of the waveguide, a first of which is rectangular and has a greater length and width than the broadwall dimesnion of the waveguide; and the other of which is circular with a diameter less than one-half the free space wavelength of the long wavelength signal. A pyramidal feedhorn directs the long signal wavelength through the reactangular aperture, where the short-wavelength signal, which also comes down through the feedhorn passes through the second aperture. The long-wavelength component instead of passing through the second aperture is deflected into the waveguide. A short-wavelength detector is positioned at the point of convergence of a ray cone passing through the first and second apertures, thus making the detected signal available for further signal processing.

25 Claims, 4 Drawing Sheets

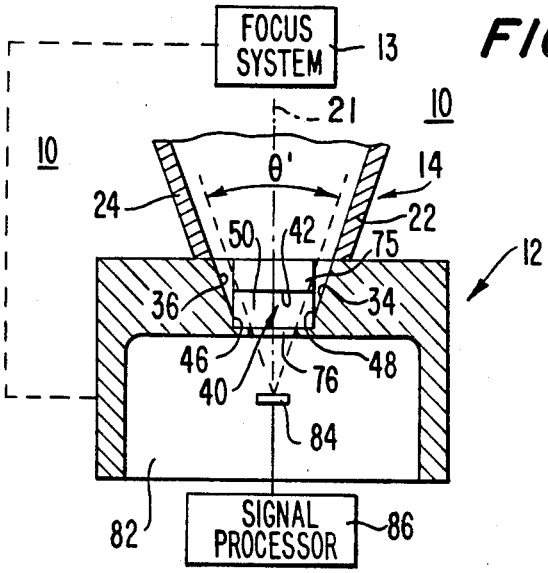
FIG. 3.
FIG. 4.
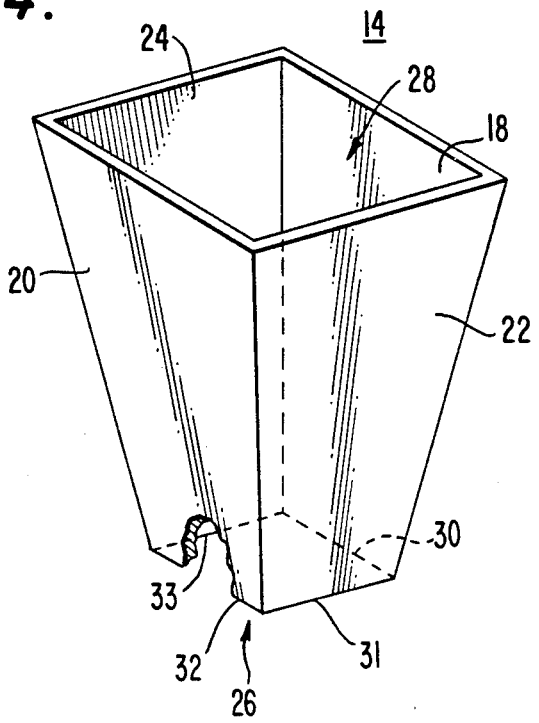

DEVICE AND METHOD FOR SEPARATING SHORT-WAVELENGTH AND LONG-WAVELENGTH SIGNALS

BACKGROUND OF THE INVENTION

Field Of The Invention

The present invention relates to signal separation, and more particularly, to a method and device for separating into distinct paths a long-wavelength signal and a short-wavelength signal having a common area of focus.

RELATED APPLICATION

U.S. patent application Ser. No. 910,826 which is a continuation of abandoned U.S. patent application, Ser. No. 711,264 filed Mar. 1, 1985 by Roger K. Youree and Vernon W. Ramsey, and assigned to the common assignee, entitled, "Wavelength Separator Comprising Different Waveguides for Separating Electromagnetic Signals of Various Wavelengths" (as amended).

DISCUSSION OF PRIOR ART

Separators which can channel into separate paths signals which differ greatly in wavelength, but which arrive concomitantly at a common area of focus, such as through the same antenna or optical system, have several applications. For example, a signal separator is needed for a dual-mode sensor which senses radiation in the microwave or millimeter wave frequency range, and as a second mode, senses radiation also in the infrared, visible, or ultraviolet range. In particular, a signal separator is required if the dual mode system is a so-called "common-optics" system; that is, one in which the two sensing wavelengths use the same antenna system, and bring both radiation beams to the same point of focus. Such common-optics dual-mode sensors are desirable in that the two beams are viewing the same point on an object at the same time, thus making it easier for the signal processor to ascertain the nature of the object being viewed. When a circulator or transmit-receive device is added to the radar wavelength channel of the signal separator, the device becomes a dual-waveband duplexer, which permits both transmission and reception of the radar wavelength in the long-wavelength path.

One category of presently known signal separators include devices, such as channelizing filters, which split the combined signal into two or more waveguides, and then in each waveguide filter out all signals not of the desired wavelength. Such power splitting, and then filtering, though, tends to severely lower the signal strength; therefore, such devices are unable to be used in applicatons having low signal power. Also, devices of this type do not appear to be practical when the wavelength bands of interest are as widely separated as the microwave and visible wavelength bands.

Another category of signal separators utilizes screens, optical filters, or dichroic filters to achieve power splitting and filtering. The devices employed are selected to reflect certain wavelengths and allow others to pass. Although it is difficult to obtain a suitable filtering material, particularly when one of the desired frequency bands is a radar band, this category of separator can handle wavebands which are widely separated in wavelength. However, where one band is a radar band and the other band is infrared or higher in frequency, media filter/screen combinations tend to be inefficient in that the radiation in one or the other of the two bands is severely attenuated after passing through or reflecting off of such filter/screen combinations.

Microwave antennas which reflect infrared radiation, such as might arise from a nuclear blast, while continuing to bring a microwave signal to a focus are also known. Although such deflecting devices are efficient at both the microwave and infrared wavelengths when compared to the media filter/screen devices, they are designed for applications in which the infrared radiation is not a signal. Thus, such antennas do not channel or direct the infrared onto a detector where it could be processed as a signal in the same manner as the microwave or millimeter wavebands.

SUMMARY OF THE INVENTION

One of the objects of the present invention is to provide an apparatus and method for channeling signals that are widely separated in wavelength into separate paths for further processing where such channeling is not effected with screens, lenses, or filters.

Another object of the present invention is to provide an apparatus and method for accomplishing such signal separation that minimizes the attenuation of either of said signals.

A further object of the present invention is to provide a method and apparatus for accomplishing such separation in a manner to effect a high degree of short-wavelength efficiency.

Additional objects and advantages of the invention will be set forth in the description which follows; and in part will be obvious from the description, or may be learned by practice of the invention. The objects and advantages of the invention may be realized and obtained by means of the instrumentalities and combinations particularly pointed out in the appended claims.

To achieve the objects and in accordance with the purpose of the invention, as embodied and broadly described herein, the method of separating short-wavelength signals and long-wavelength signals into separate paths, comprises collecting the combined signals at a common focus area; passing both signals in a first direction along a central axis into the interior of a waveguide; deflecting the long-wavelength signal through the waveguide in a second direction at an angle to the first direction; and passing the short wave signal in the first direction through an exit aperture aligned with the central axis and dimensioned to effectively block the long-wavelength signal, for converging the short-wavelength signal at a point exterior of said waveguide; and detecting the short-wavelength signal substantially at the point of convergence.

In another aspect, the present invention for channeling into separate distinct paths a short-wavelength signal and a long-wavelength signal comprises means for collecting the short-wavelength and long wavelength signals at a common area of focus, the short-wavelength signal being in the form of a ray cone having a central axis extending in a first direction; and a waveguide means for propagating the long-wavelength signal in a second direction extending at an angle to the first direction. Means are provided for passing both the short-wavelength and long-wavelength signals in said first direction into the waveguide means, together with means for deflecting the long-wavelength signal to propagate through the waveguide means in the second direction while passing the ray cone in the first direction to converge at a point external of the waveguide means, and means for sensing the short-wavelength signal substantially at the point of convergence.

Preferably, the device of the present invention comprises a housing having an exterior surface; and a waveguide means in the housing having an input/output port and having a first and second pair of spaced opposing internal surfaces defining a passageway extending along a propagation axis in one direction for propagating the long-wavelength signal along a portion of a path extending in the one direction to the input/output port. The housing in a first portion thereof has a first aperture means located in one of the first pair of internal surfaces and having a selected dimension greater than the width of the passageway. The housing in a second portion thereof has a second aperture means in the other of the first pair of internal surfaces of the passageway coaxial with the first aperture means. Collecting means having an outer end and a throat end, and tapered at a selected angle to have a cross-sectional area at the throat end smaller than the cross-sectional area at the outer end, is attached to the exterior surface of the housing adjacent the throat end and surrounds the first aperture means for directing the long-wavelength signal into the first portion of the passageway. The collecting means has a central axis extending in another direction at an angle to the one direction coaxial with the first and second aperture means; and permits the passage of the short-wavelength signal in the form of a ray cone having a point of convergence on the central axis a selected distance from the throat. The second aperture means has a diameter large enough to pass the short-wavelength ray cone to the point of convergence while effectively blocking the long-wavelength signal for deflection along the propagation axis in the one direction. A short wavelength sensing means is disposed substantially at the point of ray convergence for detecting the short-wavelength signal for processing.

The accompanying drawings, which are incorporated in and constitute a part of this application, illustrate several preferred embodiments of the invention, and, together with the description, serve to explain the principles of the invention.

BRIEF DESCRIPTION OF THE DRAWINGS

FIG. 3 is a sectional view taken on line 3—3 of FIG. 1 and looking in the direction of the arrows;

FIG. 4 is a view in perspective of a feedhorn of the present invention for use with the embodiment of FIGS. 1–3 to more clearly illustrate its configuration;

DETAILED DESCRIPTION OF PREFERRED EMBODIMENTS

Figure 1:
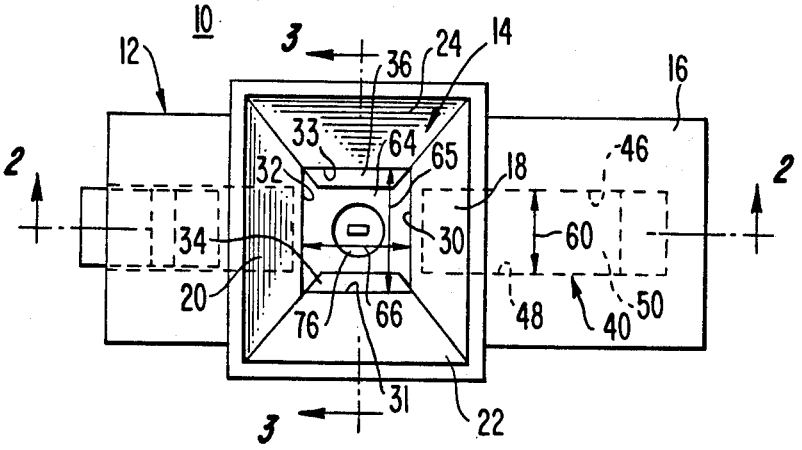
FIG. 1 is a highly magnified plan view of a signal separator according to one preferred embodiment of the present invention.
Figure 2:
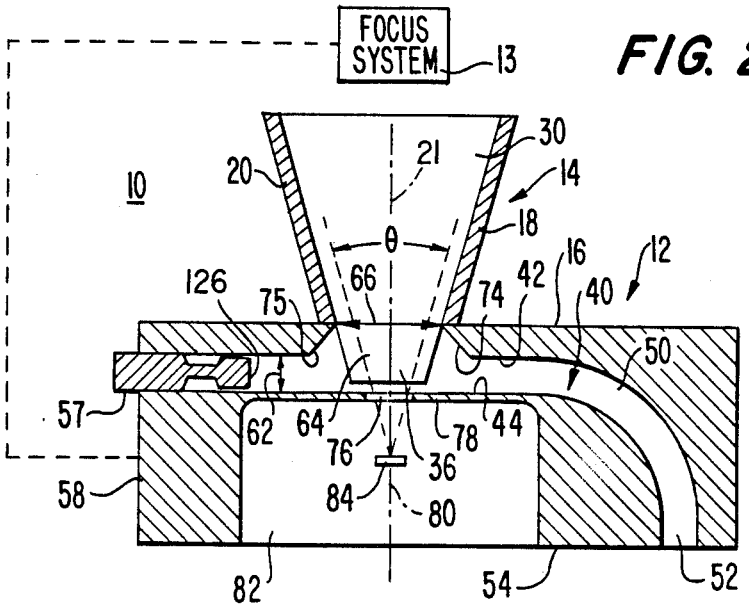
FIG. 2 is a sectional view taken on line 2—2 of FIG. 1 and looking in the direction of the arrows.
Figure 5:
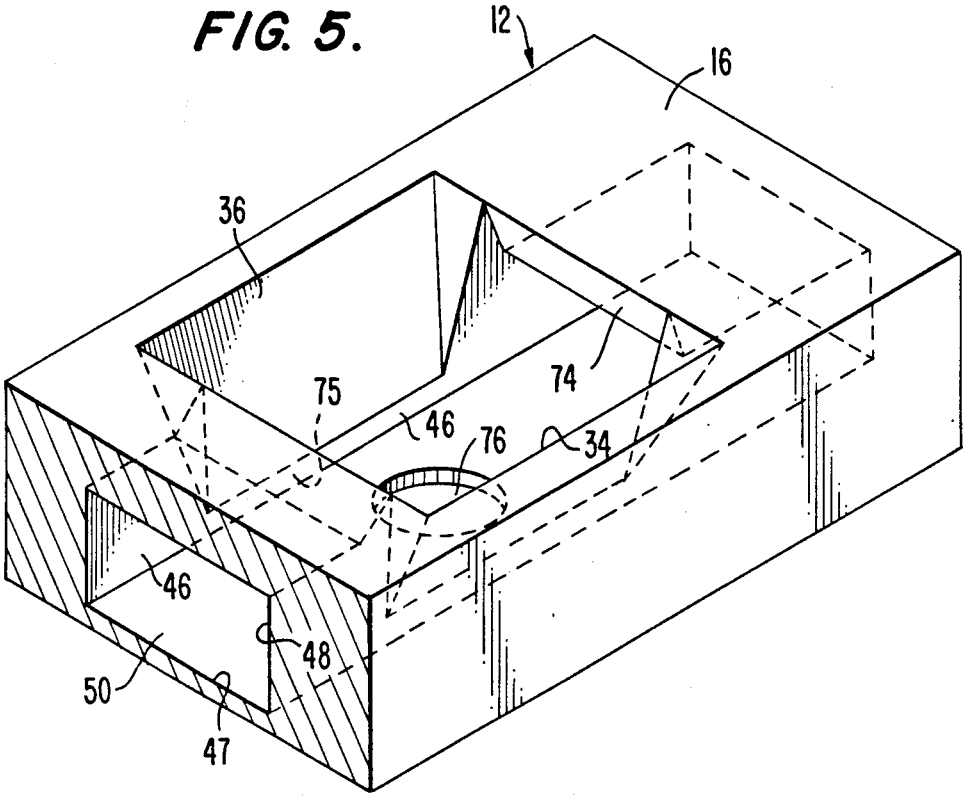
FIG. 5 is a highly magnified fragmentary view in perspective of the embodiment in FIGS. 1–3 with the feedhorn removed to more clearly illustrate the configuration of a portion of the waveguide channel.

Reference will now be made in detail to the present preferred embodiments of the invention, examples of which are illustrated in the accompanying drawings. One preferred embodiment of the long-wavelength and short-wavelength signal separator is shown in FIGS. 1 through 5 inclusive, and is represented generally by the numeral 10. As used herein, long wavelength is meant to include frequencies from the UHF region through the submillimeter region; that is, from 300 MHz to 3000 GHz, a short-wavelength signal as used herein means the infrared, visible, ultra violet and higher frequency regimes. The short-wavelength signal may be formed into a ray cone by an antenna or optical system, for example, that works in conjunction with the separator of the present invention. The actual ray cone angle is determined by such optical system or antenna. The angle $\theta$ shown in FIGS. 2 and 3 represents the maximum allowable ray cone angle that can pass to the short-wavelength detector without obstruction.

The signal separator of the present invention includes means for collecting the short-wavelength and long wavelength signals at a common focal area and accommodating without blockage the short-wavelength signal having a predetermined maximum ray cone angle.

As embodied herein, the collecting means for the short and long-wavelength signals includes a housing 12 a focus system 13 and a feedhorn 14 projecting from an external surface 16 of the housing. Focus system 13 may be any conventional type system that collects and forms a short-wavelength signal into a ray cone, such as a cassegrain antenna or optical focusing system, for example. Such system is of the type that is fixed relative to housing 12 to focus the short-wavelength radiation to a point, and is able to form a ray cone angle between approximately 11 and approximately 21 degrees, for example. Feedhorn 14 which collects the long-wavelength signal and passes the short-wavelength ray cone has a first pair of sidewalls 18 and 20, respectively; and a second pair of sidewalls 22 and 24, respectively. Sidewalls 18, 20, 22, and 24 define a pyramidal configuration that is substantially rectangular in cross-section.

Referring to FIG. 4, feedhorn 14 is tapered to have a cross-sectional area at throat end 26 that is smaller than the cross-sectional area of an outer end 28. Feedhorn 14 may be fastened to housing 12 by conventional means such as welding, brazing, or bolting (not shown), or it may even be cast integral with the housing, for example. In one reduction to practice, horn 14 was tapered such that sidewalls 18 and 20 each formed an angle of approximately 11.9 degrees relative to central axis 21, or 23.8 degrees relative to each other and sidewalls 22 and 24 formed an angle of 37.2 degrees relative to each other. Sidewalls 18 and 20 terminate at edge 30 and 32 defining throat end 26 while sidewalls 22 and 24 terminate at lower edges 31 and 33, respectively. Bevels 34 and 36 essentially extend feedhorn walls 22 and 24 into passageway 50. The area of the waveguide means 40 below throat 26 constitutes a waveguide feed region which together with the horn 14 provide the throat field orientation necessary to launch the long-wavelength signal.

The present invention includes means for propagating the long-wavelength signals through a waveguide means. As embodied herein, waveguide means referred to at 40 has a first pair of spaced opposing internal surfaces 42 and 44 (FIG. 2); and a second pair of opposing internal surfaces 46 and 48 (FIG. 3) defining a passageway 50 that is substantially rectangular in cross-section and extends linearly in a first direction for a portion of its length substantially parallel to external surface 16 of the housing. Passageway 50 curves at approximately a 90 degree angle to communicate at open end 52 in external surface 54, which is opposite external surface 16 of housing 12. A conventional shorting plunger 57, such as a non-contacting type, for example, is included in passageway 50 through an open end of the passageway opening at external surface 58 of the housing.

Passageway 50 of waveguide means 40 is dimensioned for propagating and guiding a long wavelength signal as defined herein. Passageway 50 is dimensioned such that the width of the waveguide means or the broad dimension as defined by the width of inner surfaces 42 and 44 is in excess of one-half of the wavelength in free space of the signal to be propagated. The height of the passageway 50 or the short dimension as represented by the width of internal surfaces 46 and 48 may be the standard for waveguide passageways, which typically is approximately one-half the broad dimension. In the one reduction to practice, internal surfaces 42 and 44 have a width dimension, which is commonly referred to as the "a" wall dimension represented by arrows 60 (FIG. 1) of 0.100 inches. This same passageway 50 has a height dimension commonly referred to as the "b" wall dimension represented by arrows 62 (FIG. 2), that is one-half of the width 60 or 0.050 inches.

The means for passing both the long-wavelength and short-wavelength signals into the portion of passageway 50 below the feedhorn throat 20 includes an aperture means 64 in housing 12 at internal surface 42 of the waveguide means 40. With respect to the long-wavelength signal, this aperture 64 provides communication between the interior of feedhorn 14 and passageway 50 as hereinafter described. With respect to the short-wavelength signal, aperture 64 provides for through passage of the ray cone enroute to aperture 76 and the point of convergence as hereinafter described. First aperture means 64 (see FIGS. 2 and 6) is preferably rectangular in configuration and is dimensioned to correspond to the dimensions of throat 26 of feedhorn 14. Throat 26 is the internal dimension of the feedhorn that is defined as the internal width of sidewalls 22 and 24 of feedhorn 14 (see FIGS. 1 and 4) referred to as 31 and 33, respectively and the width of sidewalls 18 and 20 at edges 30 and 32.

In accordance with the invention, throat 26 which forms aperture 64 has a substantially larger cross sectional areas than the cross sectional area of passageway 50 of the waveguide means 40. For efficient passing of both the long and the short-wavelength signals the dimensions 65 and 66 of aperture 64 (see FIG. 1) are larger than the "a" wall dimension between inner surfaces 46 and 48 of the waveguide represented by arrow 60. Since the dimensions 65 and 66 are functions of the width of the passageway 50 of the waveguide, these dimensions will vary in various devices in accordance with the wavelength of concern. Preferably, the dimensions 65 and 66 of throat 26 of feedhorn 14 are in the neighborhood of 40 percent larger than broadwall dimension 60 of passageway 50. In the one reduction to practice, the throat of the feedhorn 14, or in other words, the dimensions 65 and 66 of the aperture means are each approximately 0.140 inches; and, as previously mentioned, dimension 60 of passageway 50 is 0.100 inches.

The convergence of long-wavelength energy from feedhorn 14 into waveguide means 40 is assisted by a transition comprised of bevels 34, 36, 74 and 75. Bevels 34 and 36 extend down into passageway 50 a selected distance; thus effectively extending feedhorn sides 22 and 24. Reverse bevels 74 and 75 extend transverse to channel 50, and slant at an approximate 45-degree angle relative to top surface 16 in FIG. 2. Preferably, as clearly shown in FIG. 5, tapers 34 and 36 are carved into internal surfaces 46 and 48 to effectively extend feedhorn sidewalls 22 and 24. Since throat width 65 in the embodiment of FIGS. 1–5 is also approximately 40 percent larger than broadwall dimension of passageway 50, beveled or tapered surfaces 34 and 36 must be of sufficient depth to accommodate the aforesaid extensions of sidewalls 22 and 24, respectively. In the one reduction to practice, bevels 34 and 36 extended into passageway 50 approximately three quarters of the distance between internal surface 42 and 44. Thus, throat size 65, which is substantially larger than the broadwall dimension of passageway 50, is preferably blended into passageway 50 by continuing the pyramidal taper of the feedhorn 14 on opposite sides 22 and 24. Similarly, reverse bevels or tapers 74 and 75 serve to transition sidewalls 18 and 20 into passageway 50.

The present invention further includes means for deflecting the long-wavelength signal causing it to propagate through the channel of waveguide means in a second direction extending at an angle to the direction from which both signals enter throat 26 of feedhorn 14. The deflection of the long-wavelength signal into the waveguide means is accomplished while permitting the converging of the ray cone of the short-wavelength signal in the first direction at a point external of and at a selected distance from the waveguide means.

As embodied herein, and referring to FIGS. 1 through 5, the means for deflecting and permitting the converging include second aperture means 76 in wall 78 of housing 12. Aperture 76 and throat 64 of feedhorn 14 are coaxial with central axis 21 of feedhorn 14. (See FIGS. 2 and 3). Central axis 21 is substantially perpendicular to the plane of internal surface 42 and 44 throughout the linear portion of passageway 50. Housing 12 has a chamber 82 formed in external surface 54 that has a depth to render wall 78 as thin as is feasible. In the reduction to practice herein described, such wall 78 is 0.010 inches thick to provide a thin iris aperture 76. The diameter of aperture 76 is made large enough to accommodate the desired ray cone angle $\theta$. In so doing, however, it must be kept small enough to minimize coupling of the long-wavelength signal out of passageway 50.

As will be noted from the below-described measurements, it is possible to employ aperture 76 of sufficient size to achieve the desired ray cone accommodation angle $\theta$, while at the same time restricting long-wavelength power leakage levels through aperture 76 to no more than a few percent.

Figure 6:
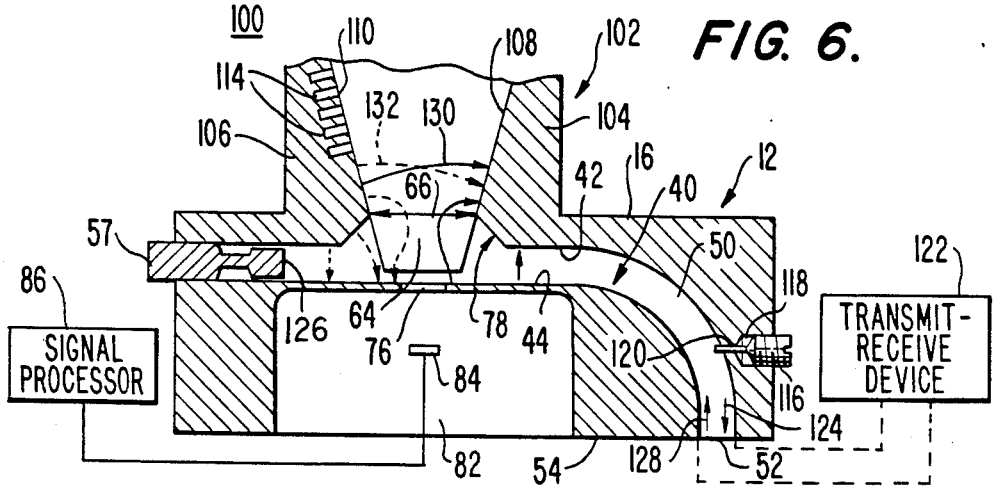
FIG. 6 is a fragmentary sectional view of the embodiment of FIGS. 1–3 as modified to include embellishments useful for correcting beam squint and for providing broadband tuning.

A conventional sensing device 84 is mounted in chamber 82 in axial alignment with aperture 76 substantially at the point of convergence of the ray cone. Detector 84 allows short-wavelength signals to be processed in many well-known ways by a conventional signal processing apparatus 86 (FIG. 6). Detector element 84 is typically contained in a small canister housing, which is either evacuated or filled with an inert gas. The top of the detector canister, which may be a well known TO-8 can has a window through which the incoming rays must pass to impinge on element 84. With respect to aperture means 76, the larger the diameter, the greater the potential for increased leakage of the microwave or millimeter wave signal out of channel 50. However, in the reduction to practice referred to herein, a device for separating short-wavelength and long-wavelength signals has been constructed to accommodate ray cone angles to over 21 degrees. The device experienced only a 2.3 percent loss of radar power due to leakage through aperture 76. In any event, as previously mentioned, the diameter of the circular aperture 76 is selected to be no larger than necessary to accommodate the short-wavelength ray cone.

Referring to FIG. 6, a device generally referred to as 100 is similar to the signal separator 10 previously described, with the exception of embellishments that may be utilized to correct the radiated beam squint and to broaden the tuning bandwidth. Device 100 that separates the short-wavelength signal and directs it to detector 84 for subsequent processing in a conventional manner by an apparatus referred to as 86 is similarly constructed and operates in a manner similar to the device described in connection with FIGS. 1 through 5. A feedhorn 102 is illustrated that is integral with a housing similar to housing 12 in FIGS. 1 through 5. Feedhorn 102 has sidewalls 104 and 106 that are configured to have internal surfaces 108 and 110, which together with adjacent sidewalls and internal surfaces form a feedhorn having similar angles and dimensions as that described in connection with FIGS. 1 through 5. Walls such as 104 and 106 of feedhorn 102 are made thicker in order to accommodate corrugations 114 formed in surfacae 110 of the feedhorn and can be formed integral with housing such as 12. Additionally, a conventional tuning screw 116 is threadably inserted in an orifice 118 formed in the housing such that projection 120 of turning screw 116 may be adjusted inwardly and outwardly of passageway 50. Because the present invention is a reciprocal device, a conventional transmit/receive apparatus may be connected in a conventional manner to effectively receive and transmit a signal in the long-wavelength or radar frequency (for example) through channel 50 of waveguide means 40.

The operation of a device of the present invention will be explained under transmit conditions; that is, where an input microwave signal is applied to a waveguide port 52 from a transmitter such as 122 (FIG. 6).

The following description of operation is confined to the long-wavelength signal. The signal separator is not ony reciprocal, but is also nearly lossless. In the microwave bands, this means that the tuning and power transfer properties of the device follow closely the properties of an ideal lossless microwave network. With an incident wave such as 124 fed into port 52, power transfer through the device 10 or 100, as the case may be, is maximized by adjusting tuning elements 57 and 116. Maximum power transfer in this case means maximum power indicated out of the feedhorn into space. The tuning element 57 is a shorting plunger which electrically shortcircuits the waveguide at inside face 126. A conventional noncontacting variety of plunger 57 is illustrated. Since adjusting of the shorting plunger influences not only reflected wave 128, but also the squint, or tilt, of the radiated beam hereinafter discussed, tuning screw 116 serves as a useful adjunct to minimize the reflected power 128 at a setting of the plunger 57 which simultaneously minimizes beam squint. In addition, the existence of the extra tuning element 116 permits tuning the device for broader operation bandwidths.

The fact that a beam might not radiate straight out of feedhorn 14 or 102 is suggested by an examination of its typical electric field lines, represented by solid arrows 130 and dashed arrows 132, near and in throat 64 of horn 102. Electric field lines represented by solid arrows 130 belong to an incident wave originating as 124; and electric fields represented by dashed arrows such as 132 belong to a reflected wave, a port 128 of which exists port 52. As the incident wave 124 travels through passageway 50 of waveguide means 40 and approaches throat 64 from the right side of the device as viewed in FIG. 6, some of the wave, as illustrated by solid arrows bends up into feedhorn 102 and continues on out as radiation with minimal reflection at mouth or throat 64 of the feedhorn. However, not all the incident wave goes up into the feedhorn. Instead, a portion of the incident wave continues on to the left, as viewed in FIG. 6, and strikes shorting wall 126. Electric field lines of the resulting reflected wave are shown by dashed arrows.

The geometrical symmetry of the throat region 64 of feedhorn 102 is such that the reflected wave indicated by dashed arrows behaves the same as the incident wave, represented by solid arrows, except in the opposite direction. In particular, some of the reflected wave turns up into the feedhorn 102, while the remainder goes into the passageway 50 as a contribution to the reflected wave 128 back at the input. Feedhorn throat region 64 is not small in wavelengths, and because of that, a wave does not maintain the same phase in traversing the region. Nevertheless, at any particular location, the phase of the reflected wave with respect to the incident wave is adjustable by moving the shorting plunger 57. For the present description, the relative phases of the two waves, as represented by solid and dashed arrows in FIG. 6, are assumed to be set as indicated by the arrowheads.

Despite the geometrical symmetry of the overall throat region 64, the feeding arrangement for an individual wave, either incident or reflected, is markedly asymmetrical. In other words, the wave travels through passageway 50 and turns a rather sharp corner adjacent to the throat 64 to travel in a direction substantially perpendicular to the passageway 50 to travel up into feedhorn 102. Because of the asymmetry in feeding, the field lines in the feedhorn are not segments of circles, but instead are distorted in such a manner that the average slope of the lines in extending from one side of the horn to the other is not zero. In other words, the field lines have a residual net tilt. Since these lines also represent the phase fronts, the radiated beam itself is tilted, or squinted. For example, the beam due to the incident wave (solid arrows) squints to the left as viewed in the drawing of FIG. 6, while the beam due to the reflected wave (dashed arrows) squints to the right as viewed in FIG. 6. The net beam is a superposition of the two contributing beams, and has a squint somewhere in between.

The beam squint will be minimized; that is, the radiated beam will be more nearly on the geometrical boresight, or central axis 21 as shown in FIGS. 2 and 3, when shorting plunger 57 is adjusted to phase the fields as depicted in FIG. 6. When plunger 57 is set to reverse the phase of the reflected fields from that shown in FIG. 6, the beam squint will maximize.

The device of the actual reduction to practice has shown the beam squint to be small, and hence a relatively minor problem. The squint exists as a side effect from utilizing a very compact feedhorn feeding arrangement in accordance with the present invention. Such a feeding arrangement is employed because it permits short wavelength detector 84 to be moved close to feedhorn throat 64, thus, permitting wider angle ray cones for the short-wavelength separation. In the actual reduction to practice referred to herein, a squint angle varied from about 2.5 to 7.0 degrees to the left, as viewed in FIG. 2, depending on the adjustment of shorting plunger 57. In most applications, a squint no greater than a few degrees may be compensated by simply tilting the feedhorn. If feedhorn tilting is not convenient for a particular application, corrugations such as 114 may be cut in surface 110 of the feedhorn to speed up the phase velocity at that surface. Speeding up the wave on the left, as viewed in FIG. 6, straightens the beam. The amount of speed up is adjusted by the depth of slots 114, with the optimum depth being somewhat greater than one quarter of a free-space wavlength at the lowest microwave frequency in the operating band. As is well known, slots such as 114 must reflect a capacitive reactance at their openings in order to increase the phase velocity of the wave over the slotted surface.

For applications where a larger ray cone aperture is desired, the invention includes a signal separator embodiment having waveguide means that has a passageway that is widened for a selected distance along its length to form a symmetrical cavity that extends outwardly from both sides of the narrower uniform portion of the waveguide passageway. Formed in the widened portion or cavity is a second aperture means that has a diameter which can approach in size, if necessary, the width of the long wavelength passageway.

Figure 7:
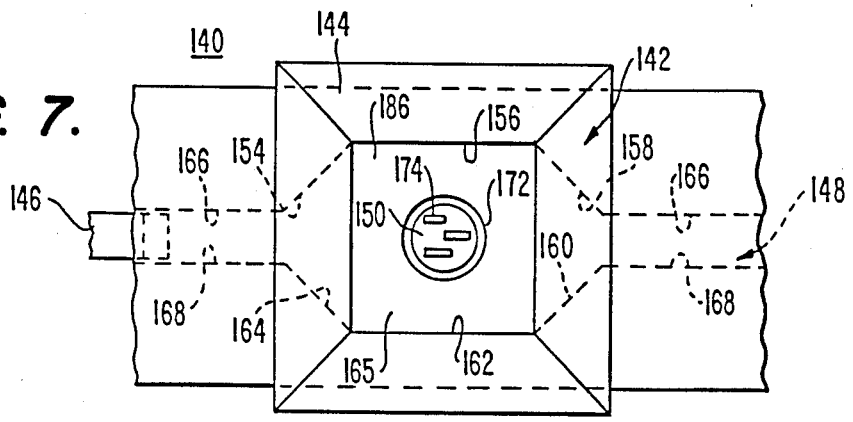
FIG. 7 is a fragmentary plan view illustrating another preferred embodiment of the present invention.
Figure 8:
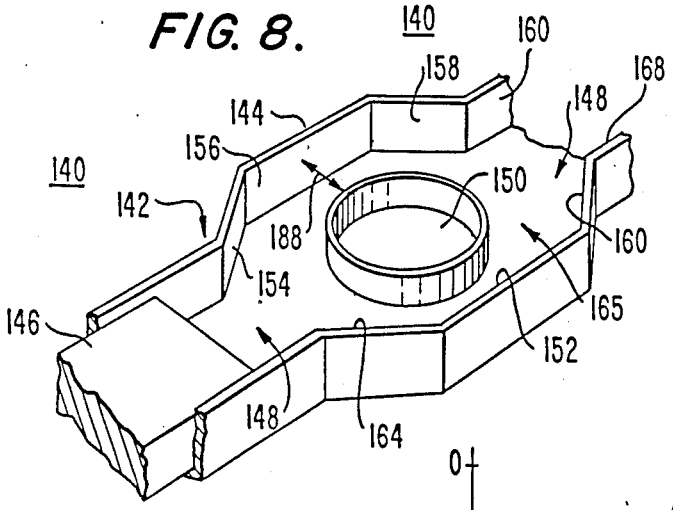
FIG. 8 is a highly magnified fragmentary view in perspective of the embodiment of FIG. 7 with the top portion of the waveguide and feedhorn removed to illustrate the aperture means for passage of the short wavelength ray cone.

As embodied herein and referring to FIGS. 7 and 8, a signal separator generally referred to as 140 includes a waveguide means 142 formed in housing 144, and has a shorting plunger 146 adjustably disposed in passageway 148 of the waveguide means 142. Passageway 148 has a broadwell dimension that exceeds one-half of the wavelength of concern in free space, similar to the previously described embodiments. To accommodate a larger second aperture means 150, passageway 148 has an inner surface that extends outwardly on both sides of second aperture means 150 to form a general octagonal surface bounded by sidewall planar surfaces 154, 156, 158, 160, 162 and 164 to form a cavity portion of the waveguide means 142 surrounding second aperture means 150. Mounted on the peripheral edge of aperture 150 is a sleeve 172 which extends into the waveguide means as much as approximately one-third the height or narrow wall dimension of cavity 165. A plurality of short-wavelength detectors such as 174 are mounted in the housing and disposed outside of the waveguide means to receive a short-wavelength ray cone through aperture means 150. Opposing internal surfaces 166 and 168 extend from cavity portion 165 to provide the normal passageway 148 for the propagation of the long-wavelength signals.

Sleeve 172 serves several purposes. It assists in transitioning the waveguide fields from cavity 165 of passageway 148 up into a feedhorn 171. Sleeve 172 provides a better impedance match as seen from the microwave input 52 as shown in FIG. 6; and reduces leakage of long-wavelength power through aperture means 150. Sleeve 172 also inhibits the establishment of higher order waveguide modes which would cause distortion in the radiated microwave beam.

Formed in housing 144 for effecting communication between passageway 148 and a collector, such as feedhorn 171, (see FIG. 7) is a rectangular first aperture means 186 that may be substantially square in cross section. This aperture is in fact formed by the throat of feedhorn 171. The dimension 188 of cavity 165 between sleeve 172 surrounding aperture 150 and flat internal surface portion 156 is sufficient to propogate the same wavelength as passageway 148, that is, dimension 188 exceeds one-half of a free space wavelength at the microwave operating frequency. Similarly, the dimension between sleeve 172 and flat internal surface portion 162, which is also equal to dimension 188 is sufficient to propagate the same wavelength as passageway 148.

In housing 144 above cavity 165, the throat of feedhorn 171 forms a first aperture 186 that is square or rectangular in configuration and has the same dimension as the throat of feedhorn 171. The length and width dimensions are each substantially longer than the width of passageway 148, where the width of passageway 148 is commonly termed the broadwall dimension. In this embodiment, one dimension of the first aperture corresponds to the length of planar surface portions 156 and 162, while the other dimension corresponds to the distance between 156 and 162. In the embodiment of FIGS. 7 and 8 the ample cavity width between walls 156 and 162 makes it unnecessary to continue the pyramidal feedhorn taper into walls 156 and 162.

The embodiment of FIGS. 7 and 8 is particularly adapted to systems in which the short-wavelength beam is scanned over large angles; or systems wherein mosaic arrays of detector elements such as 174 are utilized to record scenes, for example.

In accordance with the present invention, a method is provided for channeling short-wavelength signals and long-wavelength signals into separate paths, comprising the step of collecting the long and short-wavelength signals which has been brought to a common point of focus. A separator feedhorn may be a part of this common optics dual mode antenna by an antenna or optical system. In practicing the method of the present invention, reference will be made by way of example, to FIGS. 1 through 8 wherein the short and long-wavelength signals are collected in a feedhorn such as 14, 102 or 171 and are brought to a common point of focus along with the short-wavelength ray cone by virtue of the phase center of feedhorn 14, 102 or 171 being essentially coincident with the ray cone focal point.

The method further includes passing the collected signals in a first direction along a central axis into the interior of a waveguide. With reference to the drawings, the long-wavelength and short wave signals are directed along central axis 21, throat 64, for example, and into the interior of rectangular passageway 50 or 148. The method of the present invention further includes deflecting the long-wavelength signal through the waveguide in a second direction at an angle to the first direction. As illustrated in FIGS. 2 and 6, for example, the long-wavelength signal strikes interior surface 44 and propagates through the path of passageway 50, which in the illustrated embodiments is substantially perpendicular to the central axis 21. For a long-wavelength signal that is to be transmitted as previously described in connection with FIG. 6, the long wavelength is shorted by plunger 57 and is deflected upwardly in the direction of the central axis through throat 64 and feedhorn 102.

The method further includes the step of passing the short wavelength signal through an aperture aligned with the central axis having a diameter sufficient to pass the short-wavelength ray cone while effectively blocking the long-wavelength signal. As embodied herein, second aperture means 76 is circular in cross section, and is intended to have a diameter which permits the short wavelength signal to pass through aperture means 76 to strike sensor 84 while blocking the long-wavelength signal. In accordance with the present invention, the step of collecting includes receiving a short-wavelength signal which has been formed by an antenna into a ray cone, with the ray cone having an angle about the central axis which provides a point of convergence of the rays at a selected distance along the axis.

As shown in FIGS. 2 and 3, the geometry of the device apparatus, cavity regions and detector locations permits reception of a ray cone as large as conical angle $\theta$. Detector 84 is placed at the point of convergence. Preferably, the method comprises passing the short-wavelength and long-wavelength signal through an aperture having a cross-sectional area greater than the cross-sectional area of the waveguide passageway. As embodied herein, by providing the enlarged aperture at the throat 64 of the feedhorn, the short-wavelength signal may have a point of convergence which is much closer to the throat 64 than would otherwise be feasible. Moving the convergence point closer to the horn throat enables a wider cone angle $\theta$ to be employed; and hence makes the separator useable with a great variety of optical or antenna designs. Employed throat 64 also increases long-wavelength efficiency.

Figure 9:
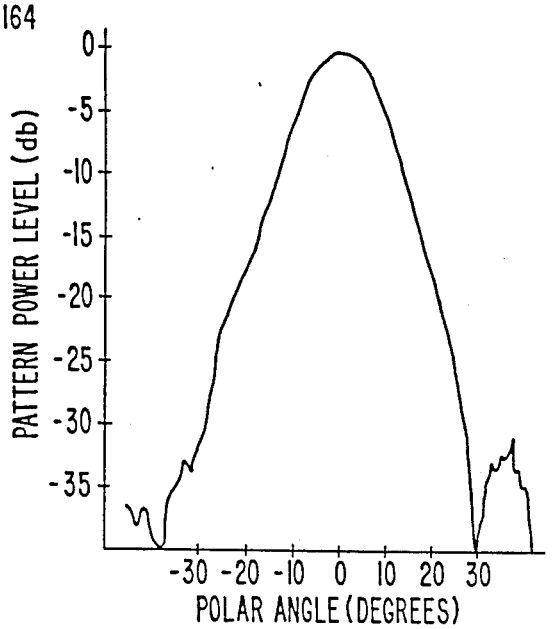
FIG. 9 is a graphical illustration of the radiation pattern of the feedhorn as a function of the angular displacement of the measurement point from the feedhorn axis.

Referring to FIG. 9, a graph of the radiation pattern of feedhorn, such as 14, is shown for the actual reduction to practice previously referred to. The reduction to practice verified the practicality of the device as described herein with regard to wave efficiencies and verified the electromagnetic influences exerted by the various features of the device. As previously mentioned, the fabricated device is designed to accept incoming short-wavelength ray cones of up to approximately 21.3 degrees and has demonstrated a long-wavelength (radar band) efficiency of approximately 86 percent. In other words, 86 percent of the wave power entering port 52 emerges from the horn 14 or 102 as radiation into space. Of the 14 percent loss, approximately 2.3 percent is due to leakage through the ray cone aperture 76. This leakage is essentially the same with or without a packaged short wavelength detector 84 inserted into cavity 82. The separator was tuned with shorting plunger 57 to provide an input voltage standing wave ratio (VSWR) of 1.13 at the frequency at which measurements were taken. Moving the shorting plunger over a span of one-half of a guide wavelength varied the beam squint from approximately 2.5 to 7.0 degrees toward the plunger side of the device. Such measurements indicated that a method and device according to the present invention has much greater efficiency at both operating wave bands than the efficiency obtained from separation devices requiring screens, lenses, and media filters.

It will be apparent to those skilled in the art that various modifications and variations can be made in the method and system for the separation of long-wavelength and short-wavelength signals without departing from the spirit or scope of the invention. For example, although an important feature of the present invention is the elimination of a basic need for screens, lenses, media filters, dichroic filters, and such, the introduction of the lens or mirror system to move the short wavelength focal point to another location would not alter the inventive concept of utilizing a reflection feed with a large throat horn and a short-wavelength ray cone aperture to achieve the signal separation. Also, although the method and system of the present invention do not require the use of directional couplers, inductive coupling loops, capacitive coupling probes, or dummy loads, the integration of a coupler or probe into a device of the present invention for the purpose of sampling the microwave signal, for example, does not alter the basic operation of the device, and hence, does not depart from the spirit or scope of the invention. It is also understood, that the introduction of tuning posts, irises, tuning screws, changes in waveguide or feed region cross sectional shapes to introduce tuning or impedance matching effects, and all additions or changes of a similar type, do not constitute a departure from the spirit or scope of the invention. Thus, it is intended that the present invention cover the modifications and variations of this invention provided they come within the scope of the appended claims and their equivalents.

What I claim is:

1. A device for channeling into separate paths a long-wavelength signal and a short-wavelength signal, said device comprising:

means for collecting the short and long-wavelength signals at a common area of focus, said collecting means including means for focusing the short-wavelength signal into a ray cone having a central axis extending in a first direction;

waveguide means for propagating the long-wavelength signal in a second direction extending at an angle to the first direction;

means for passing both the focused short-wavelength signal and the long-wavelength signal in said first direction into said waveguide means;

means for deflecting the long-wavelength signal to propagate through said waveguide means in said second direction and for passing the ray cone in said first direction to converge through the waveguide means at a point of convergence along the central axis external of said waveguide means; and means for detecting the short-wavelength signal substantially at the point of convergence.

2. A device according to claim 1 wherein said collecting means includes a feed horn tapered to form a throat area dimension greater than the area of said waveguide means, said throat are having a peripheral edge disposed symmetrically about the central axis for minimizing blockage of the ray cone formed symmetrically about the central axis.

3. A device according to claim 1 wherein the second direction is substantially orthogonal to the first direction.

4. A device according to claim 1 wherein the waveguide means has a width dimension orthogonal to the second direction, and means for passing the long- and short-wavelength signals includes aperture means opening into the waveguide means, said aperture means having a width and length dimension, said width and length dimension of said aperture means being larger than the width dimension of said waveguide means.

5. A device according to claim 1 wherein the deflecting and ray cone passing means comprises a circular aperture in the waveguide means coaxially aligned with the central axis, and having a diameter sufficient for passing the ray cone out of the waveguide means to the point of convergence, while blocking effectively the long-wavelength signal.

6. A method of channeling a short-wavelength signal and a long-wavelength signal into separate paths, said method comprising:

collecting the long and short-wavelength signals at a common area of focus, said collecting step including focusing the short-wavelength signal into a ray cone;

passing the collected signals in a first direction along a central axis into a waveguide passageway;

deflecting the long-wavelength signal through the waveguide in a second direction at an angle to the first direction;

passing the short-wavelength signal out of the waveguide passageway through an aperture in the waveguide aligned with the central axis, the aperture having a diameter sufficient to pass the short-wavelength ray cone while effectively blocking the long-wavelength deflected signal; and detecting the short-wavelength signal for processing.

7. A method according to claim 6 wherein the step of focusing the short-wavelength ray cone includes forming a cone having a predetermined maximum conical angle symmetrical about the central axis, and said steps of passing the collected signals includes passing the ray cone both into and out of the waveguide passageway to a point of convergence without obstruction.

8. A method according to claim 7 wherein the steps of passing include passing both the focused short-wavelength signal and the long-wavelength signal through another aperture in the waveguide aligned with the central axis and having a cross-sectional area substantially greater than the cross-sectional area of the waveguide passageway.

9. A method according to claim 8 wherein the step of deflecting includes deflecting the long-wavelength signal at an angle of approximately 90 degrees to the path of the short-wavelength signal.

10. A device for channeling into separate distinct paths a long-wavelength signal and a short-wavelength signal, said device comprising:

a housing having an exterior surface;

waveguide means in said housing having an input-/output port, and having a first and second pair of spaced opposing internal surfaces defining a passageway having a width dimension between the second pair of spaced opposing internal surfaces, said passageway having a first portion extending along a propagation axis in one direction, for propagating the long-wavelength signal to the input-/output port;

first aperture means in a first portion of said housing and located in one of said first pair of internal surfaces, said first means having a dimension greater than the width dimension of the passageway for passing both the short- and long-wavelength signals into the passageway;

second aperture means in a second portion of the housing in the other of said first pair of internal surfaces, said second aperture means being aligned with the first aperture means;

collecting means including feedhorn means having an outer end and a throat end, and tapered at a selected angle for forming a cross sectional area at said outer end, said feedhorn means being mounted on the exterior surface of said housing adjacent said throat end surrounding the first aperture means for directing the long-wavelength signals along a path extending into the waveguide means in another direction at an angle to the one direction, said collecting means including focusing means for forming the short-wavelength signal into a ray cone having a central axis substantially parallel to said another direction and a point of convergence a selected distance from the throat end external of the waveguide means on the central axis;

said second aperture means having a diameter large enough for passing the short-wavelength ray cone to the point of convergence at the selected distance from the throat end external of the passageway while effectively blocking the long-wavelength signal for deflection in said one direction along the propagation axis; and detecting means disposed substantially at the point of ray cone convergence for processing the short-wavelength signal.

11. A device according to claim 10 wherein the one direction extends substantially orthogonal to the central axis.

12. A device according to claim 10 wherein the second pair of internal surfaces of the passageway taper inwardly a distance corresponding to a portion of the height of the passageway in the same plane as the taper of the feedhorn means for a distance along the path of the waveguide passageway substantially coextensive with the corresponding dimension of the first aperture means for effecting the transition between the feedhorn means and the waveguide means.

13. A device according to claim 10 wherein each dimension of the throat end of the feedhorn means is greater than the width dimension of the waveguide passageway.

14. A device according to claim 10 wherein the waveguide passage is open at opposite ends, and further comprises a shorting plunger disposed in the passageway adjacent one of the opposite ends.

15. A device according to claim 10 wherein the first aperture means is rectangular in configuration and is disposed intermediate the opposite ends of the waveguide means.

16. A device according to claim 10 wherein the second aperture means is approximately circular in configuration.

17. A device according to claim 12 wherein the edges of the first aperture means that extend transverse to the propagation path of the passageway are tapered in a direction opposite the taper of the feedhorn transition between the feedhorn and the waveguide means.

18. A device according to claim 10 wherein the housing adjacent the peripheral edge of the second aperture means is 0.01 inches in thickness for permitting the point of ray cone convergence to be external of the waveguide passageway yet close to the throat of the collecting means.

19. A device according to claim 10 wherein the feedhorn means has a first and second pair of opposing sidewalls to define a pyramidal configuration, said sidewalls forming an angle relative to the central axis in another direction to permit unobstructed passage through the waveguide passage of a short-wavelength ray cone having a total conical angle in the range of from approximately 10 to 25 degrees.

20. A device according to claim 13 wherein each dimension of the first aperture means is at least forty percent greater than the width dimension of the waveguide passageway.

21. A device according to claim 14 further comprising a plurality of corrugations formed in an internal surface of the feedhorn means and extending orthogonal to the central axis for speeding up the phase velocity of the long-wavelength signal at such surface.

22. A device according to claim 14 further comprising a turning screw adjustably extending into the passageway spaced from the tuning plunger to minimize reflected long-wavelength power.

23. A device according to claim 16 further comprising a sleeve mounted on the periphery of the second aperture extending axially into the passage a selected distance not greater than approximately one-third the height of the waveguide passageway.

24. A device according to claim 23 wherein the waveguide passageway means has a greater width dimension for a distance corresponding to the dimension of the first aperture means along the passageway opposite both sides of the second aperture means.

25. A device for channeling into separate paths a long-wavelength signal and a short-wavelength signal, comprising:

means for collecting the signals at a common area of focus, the short-wavelength signal being in the form of a ray cone having a central axis extending in a first direction;

a waveguide means for propagating along a passageway the long-wavelength signal in a second direction extending at an angle to the first direction;

said waveguide means having an aperture opening into the passageway for passing the long-wavelength signals in said first direction into the passageway said aperture having a greater cross sectional area than the passageway, said aperture having a first pair and a second pair of opposing walls, each said first pair of walls extending outwardly from a respective edge of the aperture at an angle to the central axis to terminate at one surface of the passageway, each said second pair of walls extending at an angle inwardly toward said passageway to terminate in a surface of the passageway adjoining the one surface;

means for deflecting the long-wavelength signal to propagate through said waveguide means in said second direction, while passing the ray cone in said first direction through the waveguide means to converge at a point along the central axis external of said waveguide means; and means for detecting the short-wavelength signal substantially at the point of convergence.

* * * * *

UNITED STATES PATENT AND TRADEMARK OFFICE

CERTIFICATE OF CORRECTION

PATENT NO. : 4,760,404

DATED : July 26, 1988

INVENTOR(S) : Vernon W. Ramsey

It is certified that error appears in the above-identified patent and that said Letters Patent is hereby corrected as shown below: Title page:

IN THE ABSTRACT: Line 7, "dimensioh" should be --dimension--.

COLUMN 1, LINE 54, "applicatons" should be --applications--.

Signed and Sealed this

Thirteenth Day of December, 1988

*Attest:*

DONALD J. QUIGG

*Attesting Officer*

*Commissioner of Patents and Trademarks*